US005258895A

United States Patent [19]

Bosse

[11] Patent Number: 5,258,895

[45] Date of Patent: Nov. 2, 1993

[54] MOIRE LIGHT ASSEMBLY

[76] Inventor: Thomas W. Bosse, 59 Memorial Dr., Salem, Mass. 01970

[21] Appl. No.: 846,696

[22] Filed: Mar. 9, 1992

[51] Int. Cl.[5] ..... F21V 11/00

[52] U.S. Cl. ..... 362/281; 362/61; 362/284; 362/324

[58] Field of Search ..... 362/61, 80, 277, 279, 362/283, 284, 290, 322, 324, 325, 806, 811, 354, 281; 40/436

[56] References Cited

U.S. PATENT DOCUMENTS

| | | | |
|---|---|---|---|
| 2,475,365 | 7/1949 | Walsh | 362/284 |
| 3,235,987 | 2/1966 | Yates | 40/106.51 |
| 3,309,665 | 3/1967 | Kohl | 340/120 |
| 3,505,750 | 4/1970 | Yates | 40/106.53 |
| 3,643,361 | 2/1972 | Eaves | 40/106.53 |
| 3,745,966 | 7/1973 | Seager | 116/124 |
| 3,811,213 | 5/1974 | Eaves | 40/106.53 |
| 4,789,573 | 12/1988 | Jenkinson | 428/28 |
| 4,976,620 | 12/1990 | Tacquard et al. | 434/81 |

*Primary Examiner*—Stephen F. Husar
*Attorney, Agent, or Firm*—Don Halgren

[57] ABSTRACT

A moire effect light assembly for the enhancement of energizable lamps. The assembly includes a pair of moire effect grid patterns which are movable with respect to lamp as it is energized.

16 Claims, 4 Drawing Sheets

MOIRE LIGHT ASSEMBLY

BACKGROUND OF THE INVENTION (1) Field of the Invention

This invention relates to warning lights, and more particularly to light assemblies which utilize the Moire effect to increase noticability of the light.

(2) Prior Art

Lights are universally utilized to attract attention and provide indicators or warning devices. The ubiquitous automobile has brake lights to warn drivers behind that automobile that it is applying its brakes. In recent years, automobile manufacturers have added a middle tail-light, typically in the rear window area, to add additional warning capacity that the driver is braking. This additional light has to goal of providing more attention gathering characteristics. The lights however, only provide a beam of light, and have no other additional method of garnering eye contact from those who should notice it.

Some attempts at creating attention gathering means are shown in the following U.S. patents in which: U.S. Pat. No. 4,976,620 to Tacquard et al shows a device for creating moire patterns; U.S. Pat. No. 3,505,750 to Yates discloses an apparatus for creating the appearance of objects in motion by cooperating radial displays of grids; U.S. Pat. No. 3,235,987 to Yates discloses a shiftable array of bars or grids to create the effects of motion; U.S. Pat. No. 3,643,361 to Eaves presents a device using movable dot patterns to generate moire motion illusion effects and U.S. Pat. No. 4,789,573 to Jenleinson shows a key chain amusement device with patterns movable with respect to one another which are observable through a transparent cover to show the moire patterns.

These devices have not been put to truly advantageous uses. It is contemplated that moire effect devices could be adapted to constructive purposes.

It is therefore an object of the present invention to provide a novel moire effect device which is arranged to provide an attention evoking means.

It is a further object of the present invention to provide a moire effect which is self actuating to produce a warning signal.

BRIEF SUMMARY OF THE INVENTION

The present invention involves the adaption of the moire effect as a visual enhancement for use in vehicle warning lights or other signal means for advertisement or the like.

In one preferred form of the invention, a moire effect assembly is utilized in a stop light of an automobile where the visual display of a brake light is enhanced by relative motion of a pair of grid patterns arranged between a light source, and a lens.

The moire effect assembly comprises a light source in a light source housing. The housing has a front opening for passage of a light beam. A first transparent grid pattern is disposed in the path of the light beam, and a further transparent grid pattern is movably supported adjacent the first transparent grid pattern, and within the light beam. The further transparent grid pattern may be movable with respect to the first grid pattern by inertia means, by actuatable motive means or the like. A colored or focusing lens may be sequentially disposed in the light beam to direct the grid pattern affected beam as appropriate.

In a preferred embodiment, the light housing is secured to a front plate, through which its light beam is arranged to shine. The front plate has a pair of opposed support tracks above and below each transparent grid pattern. The first grid pattern may be fixedly disposed in its opposed support tracks. The other grid pattern is transversly slidable in its support tracks, being biased in one direction and pushed away by a rotary cam wheel, the rotation of which effectuates transverse (parallel) displacement of the outer grid pattern with respect to the first grid pattern. A lens may be attached as well, to the front plate of the assembly.

The rotary cam wheel is actuated by a motor mounted onto the backside of the front plate, adjacent the light housing. When a device of this embodiment is utilized as a signal, warning, stop or brake light, the motor may be rotatively energized when the light within the light housing is lit. The relative motion of the grid patterns causes a moire pattern to be created in the light beam, and hence in the beam or signal passing from the lens.

A further embodiment contemplates a slightly different light housing and front plate of the aforementioned embodiment. The first grid pattern may be fixedly attached to that front plate, or may be disposed for transverse movement between a pair of parallel tracks. The second grid pattern is transversely shiftable with respect to the front plate and to the first grid pattern, by attachment to a solenoid device pulling against a spring biasing means which provides the return force. The solenoid device may be in electrical communication with the light in the light housing, so that movement of the second grid pattern takes place with respect to the first grid pattern and the light from the light housing. The beam, now in a moire display, is directed through a lens, colored or otherwise, in front of the grid pattern configuration.

In a further embodiment of the moire effect assembly, a lamp is arranged in a light housing disposed onto a front plate. The front plate has an opening in alignment with the open side of the light housing. The first grid pattern is arranged over the opening in the front plate. A second grid pattern is pivotally supported adjacent to and parallel with the front plate. A weighted finger is pivotably disposed adjacent the second grid pattern. Movement of the moire effect assembly, such as a deceleration of a car or truck carrying this assembly, would cause inertial forces to make the weighted finger pivot, and apply a force against the second grid pattern to make the second grid pattern move with respect to the first grid pattern thus causing the moire effect, when the lamp in the light housing is energized. A lens, colored or otherwise, is likewise arranged in light effect communication with the moire light beam emenating through the grid patterns.

The moire effect assemblies may be utilized as brake or warning lights in motor wehicles, to further attract motorists' attention that the vehicle is braking. The electrically empowered grid patterns could also be adapted in traffic lights or electronic stop signs to make them more visible to the motoring public.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
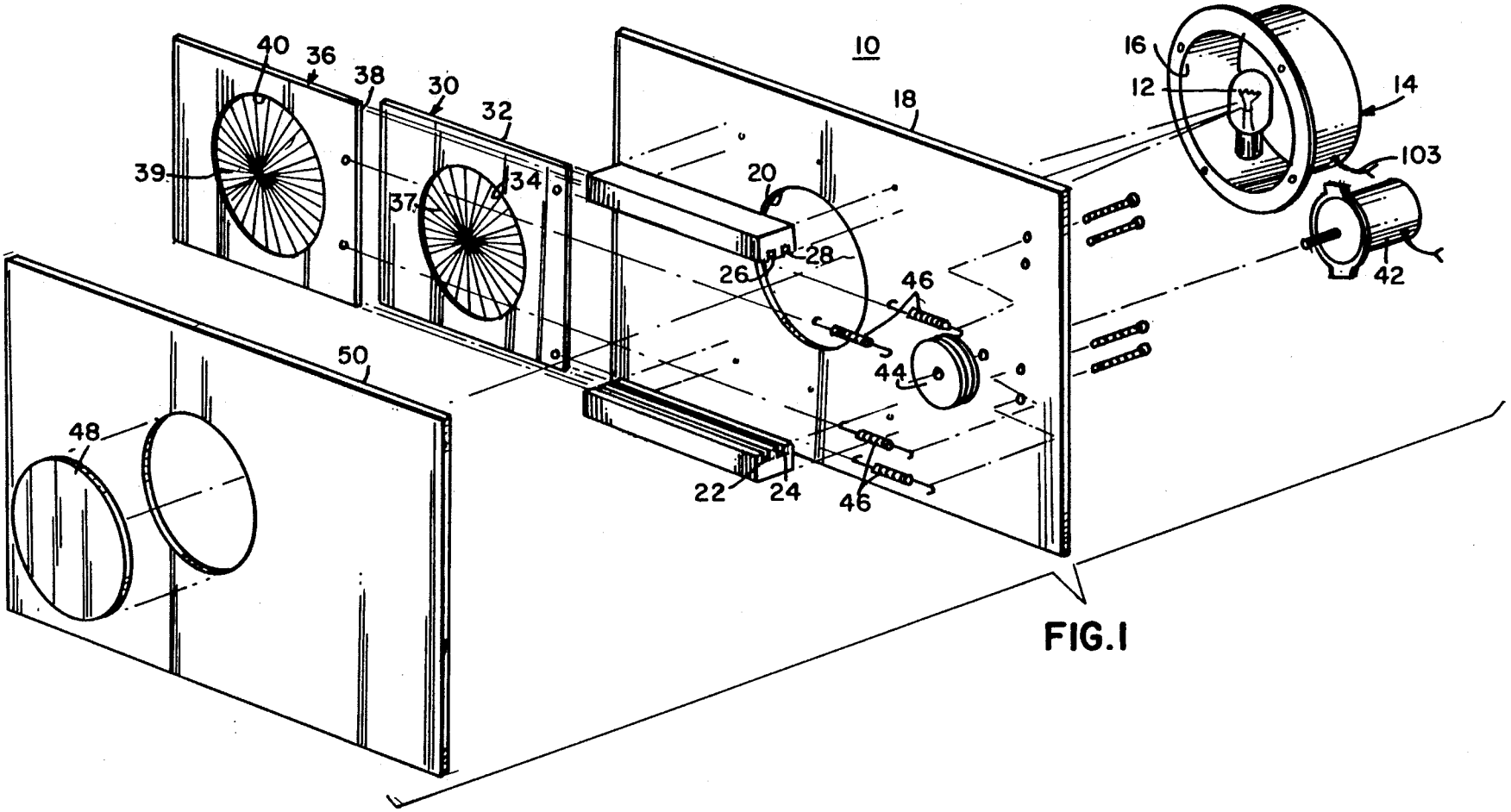
FIG. 1 is a perspective exploded view of one embodiment of a moire light assembly constructed according to the principles of the present invention.

Referring now to the drawings in detail, and particularly to FIG. 1, there is shown a moire effect assembly 10 which includes a lamp 12 in a lamp or light housing 14. The housing 14 may be of cylindrical shape, as shown, or otherwise, being diffusely or specularly reflrective, and having an open end 16. The lamp 12 is electrically energizable, through proper circuitry, not shown, when actuated by proper means such as a brake means, not shown.

Figure 4:
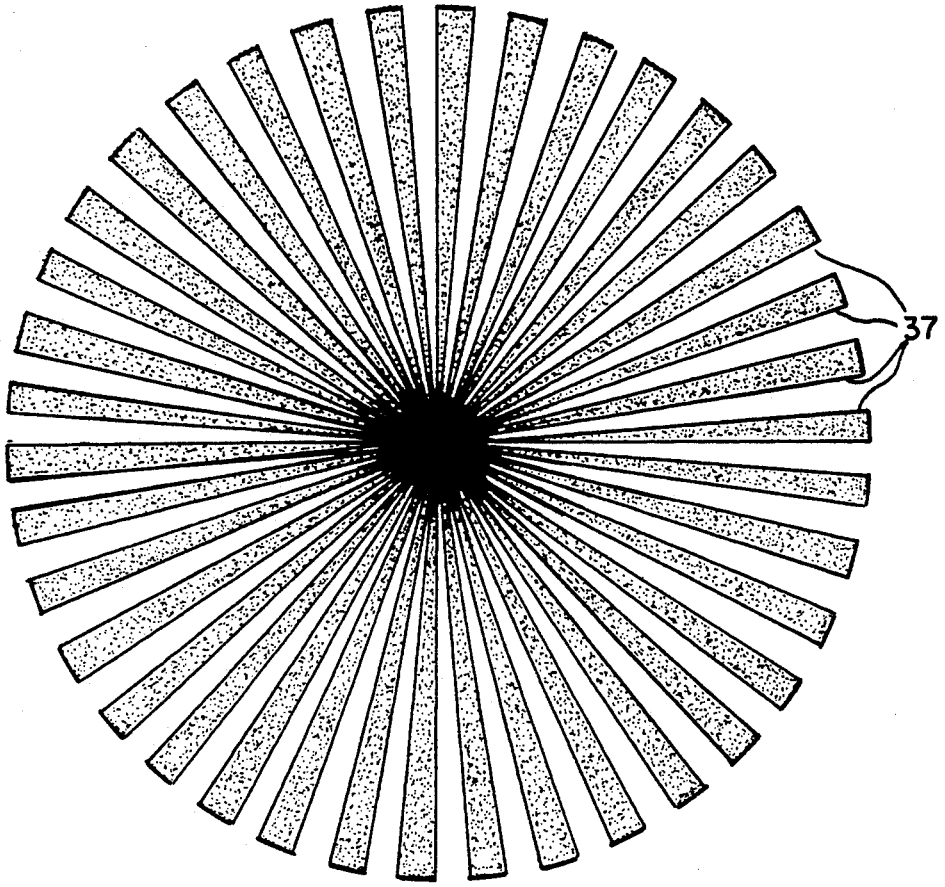
FIG. 4 is a sample of a grid pattern utilized in the creation of moire effects.

The open end 16 of the housing 14 is attached to the back side of a front plate 18. The front plate 18 has an opening 20 in alignment with the open end 16 of the housing 14. A pair of lower linear support tracks 22 and 24 are disposed on the front side of the front plate 18, beneath the opening 20. A pair of upper linear support tracks 26 and 28 are disposed on the front side of the front plate 18, above the opening 20. Each support track 22, 24, 26 and 28 comprises a U-shaped groove, all arranged parallel to one another. A first grid pattern 30 is supportively arranged in a first pair of the support tracks 24 and 28. The first grid pattern 30 comprises a panel 32 having a central opening 34 in which a transparent/translucent lens array of marks 37 is disposed, a typical grid pattern being shown in FIG. 4. A second grid pattern 36 is supportively arranged in a second pair of the support tracks 22 and 26. The second grid pattern 36 comprises a panel 38 having a central opening 40 in which a transparent/translucent lens array of marks 39 is disposed.

A rotatively energizable motor 42 may be secured to the back side of the front plate 18. The motor 42 has a shaft which extends through an opening in the front plate 18 and is secured to an eccentric, dual offset surfaced cam wheel 44. A biasing spring means 46 is arranged between both of the grid patterns 30 and 36 and the front plate 18, as shown in FIG. 1.

A front lens 48 is arranged in coaxial alignment with the opening 20 in the front plate 18, the lens 48 being supported in a cover plate 50. The motor 42 may be energized through a proper circuit, not shown, simultaneously with the energization of the lamp 12.

Energization of the lamp 12 and concomitant energization of the motor 42 causes light to shine through the opening 20 in the front plate 18 as well as rotation of the cam wheel 44. Each respective offset surface of the cam wheel 44 is in rubbing contact with an edge of the first grid pattern 30 and with the second grid pattern 36, forcing them away from the axis of rotation of the wheel 44, the biasing springs 46 pulling them back. Each surface of the cam wheel 44 being offset, is out of alignment with one another, so as to effectuate slight relative motion between each of the grid patterns 30 and 36 and the light beam in front of the front plate 18. The relative motion of the grid patterns 30 and 36 and hence their lens array marks 37 and 39 creates the moire effect which is transmitted through the lens 48, thus creating the attractive nature of the assembly 10.

Figure 2:
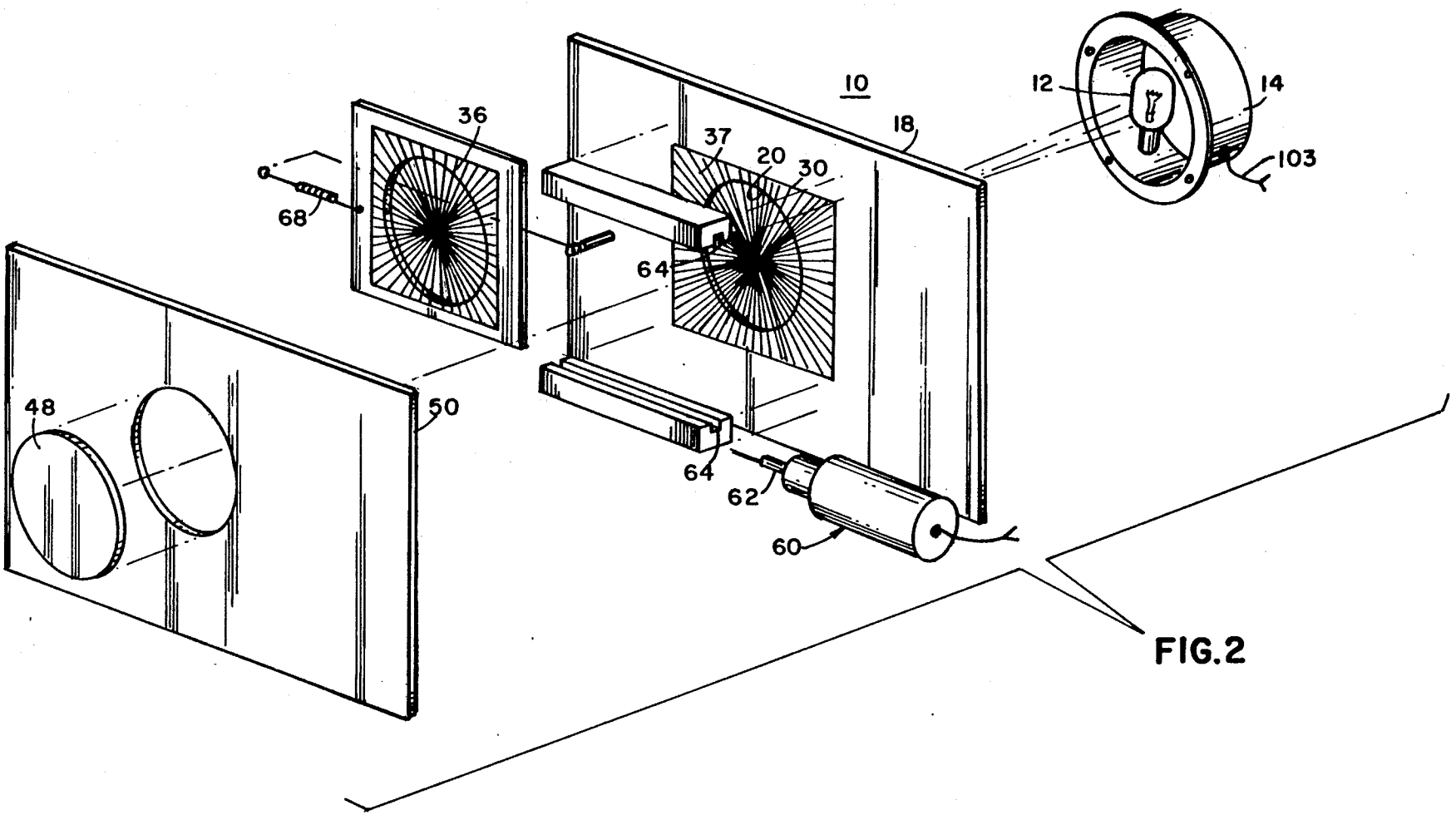
FIG. 2 is a perspective exploded view of a second embodiment of the assembly shown in FIG. 1.

A second embodiment of the moire effect assembly 10 is shown in FIG. 2, having a similar lamp 12, housing 14, front plate 18, front plate opening 20, first grid pattern 30, second grid pattern 36, cover plate 50 and front lens 48. The primary difference between this embodiment and the aforementioned, resides in the use of a shifting means 60, such as a pneumatic piston or an electrically actuated solenoid or the like, having an arm 62, the distal end of which is in articulable connection with the second grid pattern 36, which is slidable in upper and lower parallel support tracks 64. The shifting means 60 could be a double acting piston, or a biasing spring 68 be secured between the second grid pattern 36 and the front plate 18, so as to effect one of the forces acting thereupon.

Energization and lighting of the lamp 12 would generate a light to pass through the opening 20 in the front plate 18 and into the first grid pattern 30 secured thereacross. The first grid pattern 30 would have markings 37 of such a nature as to generate a moire effect when a similar grid pattern, such as the second grid pattern 36, is moved in close proximity thereadjacent, by the shifting means 60. The relative motion thus generated a moire effect, which is transmitted through the lens 48 in the front cover 50.

Figure 3:
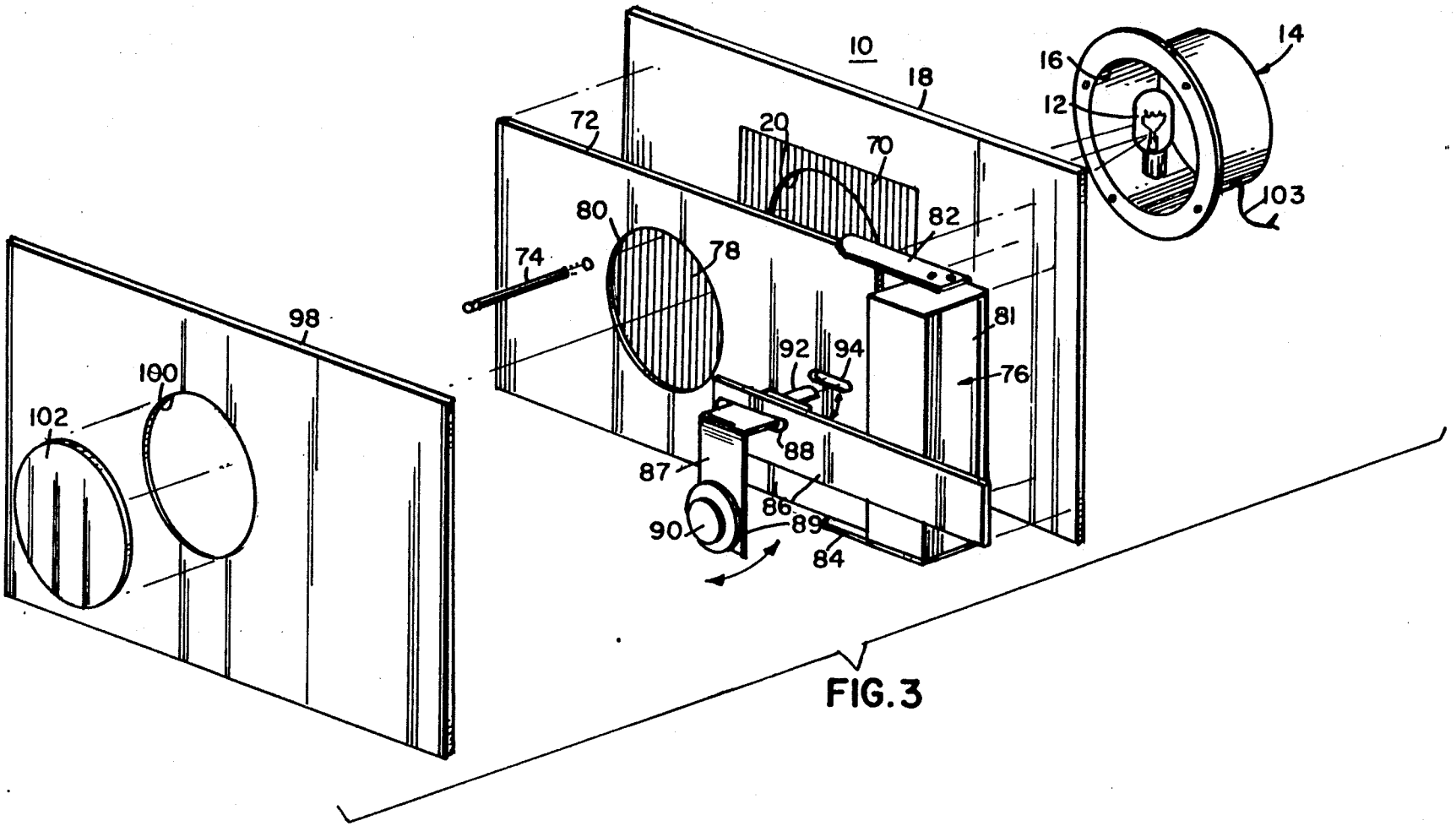
FIG. 3 is a perspective exploded view of a third embodiment of the assembly shown in FIG. 1.

A third embodiment of the moire effect assembly 10 is shown in FIG. 3, which includes a lamp 12 in a housing 14, similar to the aforementioned embodiments. The housing 14 has an open end 16 which is securable to the backside of a front plate 18. The front plate 18 has an opening 20 in alignment with the open end 16 of the housing 14.

A first grid pattern 70 is attached across the opening 20 in the front plate 18. A second plate 72 is pivotably disposed on a pivot pin 74 in front of the front plate 18. The pivot pin 74, shown in FIG. 3, is disposed to one side of the opening 20, and a support means 76 is attached to the front side of the front plate 18. A second grid pattern 78 is disposed across an opening 80 in the second plate 72. The support means 76 keeps the second grid pattern 78 in relative alignment with the first grid pattern 70. The support means 76 comprises a vertical bar 81 attached to the front side of the front plate 18. An upper flexure 82 extends off of an upper portion of the bar 81, and into touching contact with an upper edge of the second plate 72. A lower flexure 84 extends off of a lower portion of the bar 81, and into supportive touching contact with a lower edge of the second plate 72. A rigid horizontal arm 86 is attached to the bar 81 and extends part way across the second plate 72. An "L"-shaped swing finger 87 is disposed in a slot 88 near the distal end of the arm 86. The swing finger 87 has a lower end 89 which carries an inertial weight 90. The swing finger 87 has a tab 92 on its other end which loosely engages a slot 94 on the second plate 72. The swing finger 87 is permitted to rock or swing in the slot 88 in the arm 86.

A cover plate 98 is arranged in front of the second plate 72. The cover plate 98 has an opening 100 which supports a lens 102. The lens 102 is in light communication with the lamp 12 in the housing 14.

In operation, for example, a brake light function in a car or truck, utilized when the brakes are applied, causes the lamp 12 to be lighted as in a standard brake light through a proper circuit 103. However, the inertial weight 90 also would be caused to move relative to the front plate 18 in the vehicle as it slows down by the braking action, thus making the swing finger 87 pivot in the slot 88. The tab 92 also would pivot and therefore make the second plate 72 and its grid pattern 78 move arcuately in front of the first grid pattern 70 as the lamp 12 is lighted, thus generating a moire effect because of inertial forces acting upon the assembly 10.

It is to be noted that the pivot pin 74 could alternatively be attached to the front plate 18, directly over the top of the opening 20, or center of gravity in the second plate 72, eliminating the need for the flexible fingers 82 and 84. The second plate 72 would then hang from that central pin 74 and still be given a transverse arcuate swing with respect to an inertia generated swing of the swing finger 87, which is aligned in the direction of motion of the vehicle which carries it.

Thus there has been shown a unique light assembly for generating an attention grabbing moire effect which would be particularly useful for vehicles. The relative (transverse) motion of two grid patterns could be effectuated in conjunction with a brake light, or the relative (transverse) motion of two grid patterns could be effectuated in conjunction with the braking of a vehicle by the inertia effect of that braking, on a mass which thru a pivot finger pivoting in alignment with the direction of travel of the vehicle, effects such relative grid pattern motion.

I claim:

1. A moire effect light assembly for the visual enhancement of a light signal coming from an electrically energizable lamp, comprising:

a first grid pattern arranged adjacent said energizable lamp;

a second grid pattern arranged adjacent said first grid pattern, said first and second grid patterns being movable relative to one another and in light communication with said energizable lamp; and means for effectuating relative motion between said first and second grid patterns as said lamp is energized to generate said moire effect and make said light signal more noticable.

2. A moire effect light assembly as recited in claim 1, wherein said first grid pattern is held stationary with respect to said energizable lamp; and said second grid pattern is movable with respect to both said lamp and said first grid pattern.

3. A moire effect light assembly as recited in claim 1, wherein said second grid pattern is arranged in support tracks which permits controlled movement of said grid pattern.

4. A moire effect light assembly as recited in claim 3, wherein said means for effectuating relative motion comprises an energizable motor having rotatable cam means for engaging said grid pattern and instigating said motion therein.

5. A moire effect light assembly as recited in claim 3, wherein said means for effectuating relative motion comprises an actuatable arm energized when said lamp is energized, to instigate said motion therein.

6. A moire effect light assembly as recited in claim 5, wherein said means for effectuating relative motion comprises an inertial mass movable in a direction transverse to the direction of motion of said grid pattern, by a loose pivoting interengagable relation therebetween.

7. A moire effect light assembly as recited in claim 6, wherein said inertial mass is arranged at one end of a swingable finger, the finger having another end which is in pivotable relationship to said grid pattern.

8. A moire effect light assembly as recited in claim 7 where the grid pattern itself is pivotably disposed adjacent said lamp.

9. A moire effect light assembly as recited in claim 5, wherein said actuatable arm is attached to an energizable solenoid, said solenoid being energized simultaneously with said lamp to facilitate proper timing between the lighting of said lamp and the relative movement of said grid patterns for the creation of the moire effect.

10. A method of enhancing the attractiveness of a brake light assembly, comprising the steps of:

providing a lamp in the brake light assembly;

providing a moire effect grid pattern arrangement adjacent said lamp and in light communication therewith;

energizing said lamp; and moving at least part of said grid pattern arrangement with respect to said lamp at the same time said lamp is energized, so as to generate a moire effect in the light shining from said lamp and through said grid patterns.

11. The method of claim 10, including the steps of:

supporting a grid pattern of said grid pattern arrangement in a support track adjacent said lamp;

moving said supported grid pattern by an energizable means as said lamp is energized.

12. The method of claim 10, including the steps of:

supporting in a pivot at least one of said grid patterns adjacent said lamp;

pivoting said supported grid pattern by an inertially actuated means as said lamp is energized.

13. The method of claim 10, including the steps of;

energizing a motor driven cam in conjunction with energization of said lamp wherein said cam is in contact with said grid pattern to effectuate relative motion between the grid patterns, so as to create the moire effect when said lamp is energized.

14. The method of claim 12, including the step of:

arranging a weighted finger in loose rocking engagement with one of said grid patterns, so as to effectuate pivoting of said grid pattern when inertia pivots the weighted end of said finger.

15. The method of claim 10, including the step of:

arranging a lens in light communication with said grid patterns and said lamp to further enhance the light signal passing therefrom.

16. The method of claim 12, including the step of:

supporting said pivotable grid pattern on an arrangement of flexures so as to keep said grid patterns in alignment with light from said lamp.

* * * * *